United States Patent [19]

Rabassa

[11] 4,314,431

[45] Feb. 9, 1982

[54] MORTAR-LESS INTERLOCKING BUILDING BLOCK SYSTEM

[75] Inventor: Ernest A. Rabassa, Miami, Fla.

[73] Assignee: S & M Block System of U.S. Corporation, Miami, Fla.

[21] Appl. No.: 108,350

[22] Filed: Dec. 31, 1979

[51] Int. Cl.[3] ..... E04B 2/00; E06B 1/00

[52] U.S. Cl. ..... 52/259; 52/204; 52/300; 52/439; 52/593

[58] Field of Search ..... 52/259, 300, 286, 436, 52/439, 204, 595, 593

[56] References Cited

U.S. PATENT DOCUMENTS

| | | | |
|---|---|---|---|
| 1,930,951 | 10/1933 | Dotson | 52/439 X |
| 2,250,319 | 7/1941 | Wright | 52/439 X |

FOREIGN PATENT DOCUMENTS

| | | | |
|---|---|---|---|
| 1105 | 6/1964 | Dominican Republic . | |
| 5 | 5/1976 | Ecuador . | |
| 128 | 11/1977 | El Salvador . | |
| 816452 | 2/1954 | Fed. Rep. of Germany | 52/286 |
| 1006748 | 1/1952 | France | 52/259 |
| 1070750 | 2/1954 | France | 52/286 |
| 1071439 | 3/1954 | France | 52/259 |
| 1082802 | 6/1954 | France | 52/259 |
| 1094413 | 12/1954 | France | 52/259 |
| 2172 | 11/1976 | Honduras . | |
| 422004 | 7/1947 | Italy | 52/286 |
| 2163521 | 2/1975 | Nicaragua . | |
| 32123 | 4/1975 | Panama . | |
| 14326 | of 1906 | United Kingdom | 52/593 |
| 2199 | 11/1975 | Venezuela . | |

*Primary Examiner*—Alfred C. Perham
*Attorney, Agent, or Firm*—Jesus Sanchelima

[57] ABSTRACT

A set of interlocking building blocks capable of being assembled with each other forming wall structures without requiring mortar or any other binder. The set consists of four types of blocks and one lintel rib which are capable of forming wall structures and openings in said structures that are adapted to cooperate in locking relationship to prevent transverse or longitudinal movement of the blocks relative to one another.

1 Claim, 15 Drawing Figures

FIG. 1.
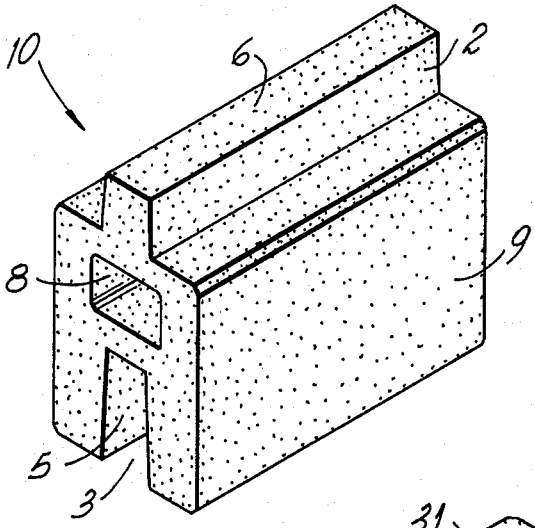
FIG. 2.
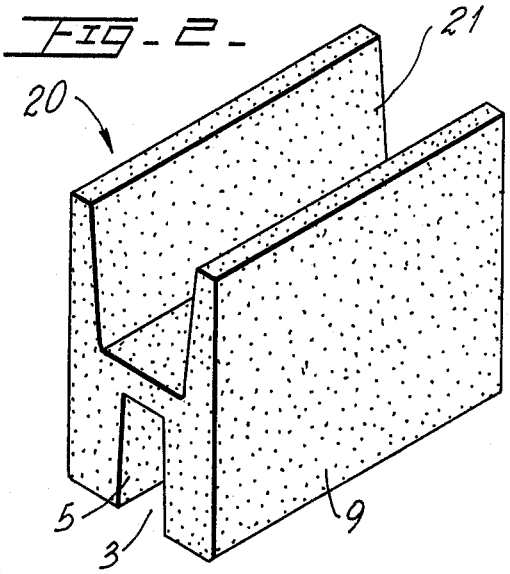
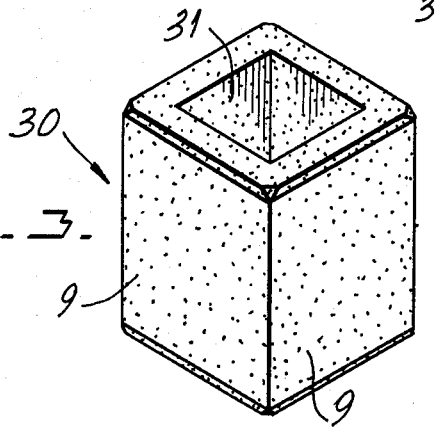
FIG. 3.
FIG. 4.
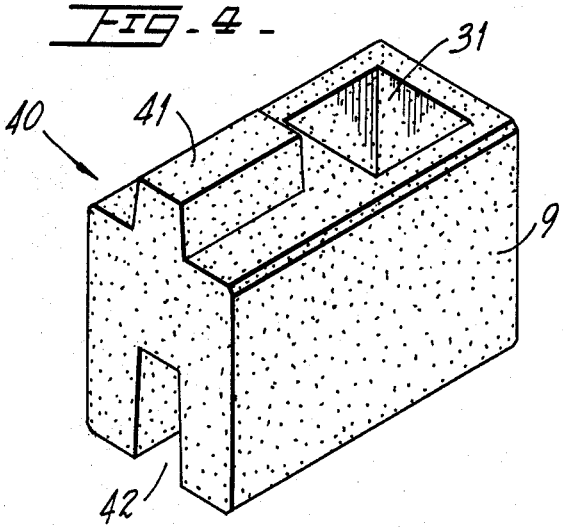
FIG. 5.
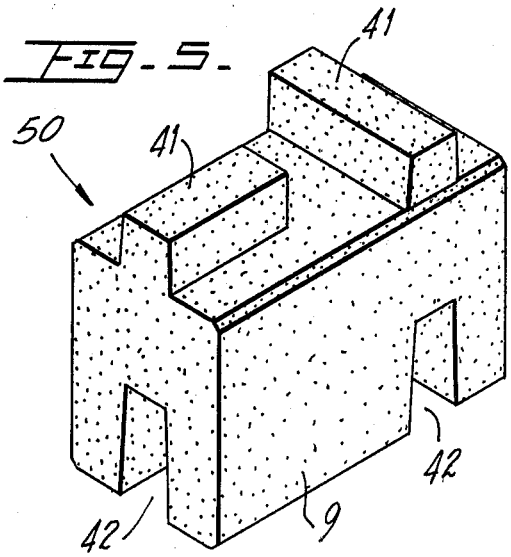

MORTAR-LESS INTERLOCKING BUILDING BLOCK SYSTEM

BACKGROUND OF THE INVENTION

1. Field of the Invention

This invention relates to mortarless interlocking blocks capable of being easily assembled in longitudinally staggered or aligned rows and, more particularly, to the special interlocking terminations on said blocks and the system for forming wall structures.

2. Description of the Prior Art

Several attempts have been made in the past to reduce ever increasing construction labor costs. Laying blocks constitute a big portion of the direct labor cost. The need for a sturdy structure limits the economic steps that may be taken to reduce cost. It is worthwhile noting the approach taken by J. Roe in U.S. Pat. No. 2,392,551 wherein the interlocking block described and claimed is believed to be the closest prior art to the present invention. Roe's block, however, has a dovetail termination that requires the lifting and aligning of the block with other blocks already laid on the structure before it can be laid. Also, the keys and keyways need to be matched before the blocks can be laid. Using these blocks would be a prohibitive time-consuming proposition with today's rising labor costs.

Other patents for interlocking building blocks provide for a number of more or less complicated features that fail to solve the problem of building a sturdy and economical wall structure. Refer to U.S. Pat. Nos. 2,291,712; 2,544,983 and 1,430,431. None of these patents suggest the novel features of the present invention.

OTHER RELATED PATENT APPLICATIONS

The present application relies in part on subject matter previously caused to be patented in several countries in Central and South America, namely:

(a) El Salvador, No. 128, Book 15, Nov. 22, 1977.
(b) Dominican Republic, No. 1105, June 11, 1964
(c) Venezuela, No. 2199, Nov. 21, 1975.
(d) Ecuador, No. 5, May 17, 1976.
(e) Honduras, No. 2.172, Nov. 29, 1976.
(f) Panama, No. 32123, Apr. 14, 1975.
(g) Nicaragua, No. 2163521, Feb. 28, 1975.

SUMMARY OF THE INVENTION

It is the object of the present invention to provide a set of interlocking building blocks that may be easily assembled in longitudinal staggered or aligned rows.

It is another object of the present invention to provide interlocking building blocks that, when assembled forming a structure, do not require mortar or any other binder to form a solid and sturdy wall.

It is still another object of this invention to provide a system comprising five different block types that will cooperate with each other forming wall structures with a minimum labor content.

It is yet another object of the present invention to provide an efficient system of interlocking mortarless construction blocks that are safer and require less equipment and trained personnel to be used in building wall structures.

It is another object of this invention to provide an interlocking block that, when assembled in staggered or aligned rows, there is a longitudinal horizontal opening along each row formed between abutting blocks, inside which electrical wiring, conduits or insulation material may be placed.

It is another object of this invention to provide a mortarless interlocking block with finished surfaces, thereby requiring no plastering.

It is another object of this invention to provide a mortarless interlocking block system capable of being used by unskilled personnel to form wall structures that are sturdy and resistent to loads and seismic movements.

The invention also comprises such other objects, advantages and capabilities as will later more fully appear and which are inherently possessed by the invention.

BRIEF DESCRIPTION OF THE DRAWINGS

With the above and other related objects in view, this invention consists in the details of construction and combination of parts as will be more fully understood from the following description, when read in conjunction with the accompanying drawings, in which:

FIG. 1 illustrates a standard mortarless interlocking block, in perspective.

FIG. 2, illustrates a tie beam mortarless interlocking block, in perspective.

FIG. 3 illustrates a cube mortarless interlocking block, in perspective.

FIG. 4 illustrates a column mortarless interlocking block, in perspective.

FIG. 5 illustrates a corner mortarless interlocking block, in perspective.

DETAILED DESCRIPTION OF THE PREFERRED EMBODIMENT

Figure 12:
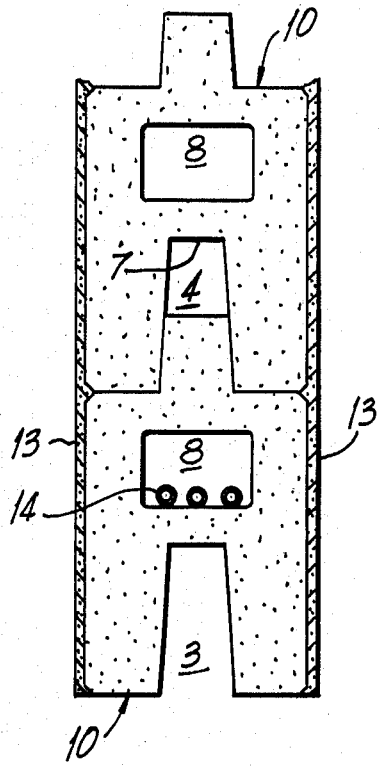
FIG. 12 illustrates two abutting standard blocks.
Figure 13:
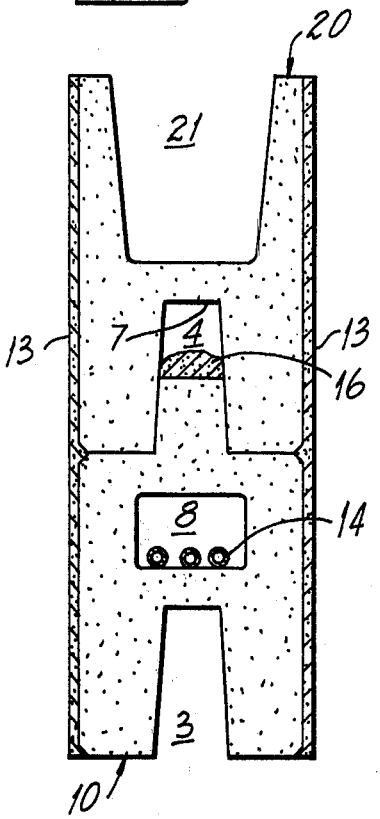
FIG. 13 illustrates a standard block and a tie beam block in a typical application.

Referring now to FIG. 1, where the standard mortarless interlocking block 10 is shown, it is seen that it has a substantially rectangular shape with a longitudinal trapezoidal built-in protrusion 2 along the center of its upper side. Block 10 also has a longitudinal trapezoidal slot 3 which is capable of receiving said protrusion 2 when the blocks are staggered or aligned in abutting rows as shown in FIGS. 12 and 13. A longitudinal space 4 is formed, as illustrated in FIGS. 12 and 13 as defined by the inner walls 5 and ceiling 7 of said trapezoidal slot 3 and the top 6 of said protrusion 2. Finally, block 10 has a longitudinal opening 8 located between the protrusion 2 and the slot 3 that acts as a thermal and acoustic insulator and it can also be used to route pipes, electrical wiring and any other conduits through it. The finished sides 9 may have a finished texture since these mortarless blocks do not require plastering, thereby reducing the associated labor and material costs.

FIG. 2 shows a tie beam mortarless interlocking block 20 which differs from the standard block 1 in that it does not have the longitudinal opening 8 and the tie beam longitudinal slot 21 is larger than longitudinal trapezoidal slot 3. Tie beam block 20 does not have the protrusion 2 of the standard block 10 since it is intended to be on the last rows of blocks, in a wall structure, supporting a tie beam which forms the base for the roof.

Figure 6:
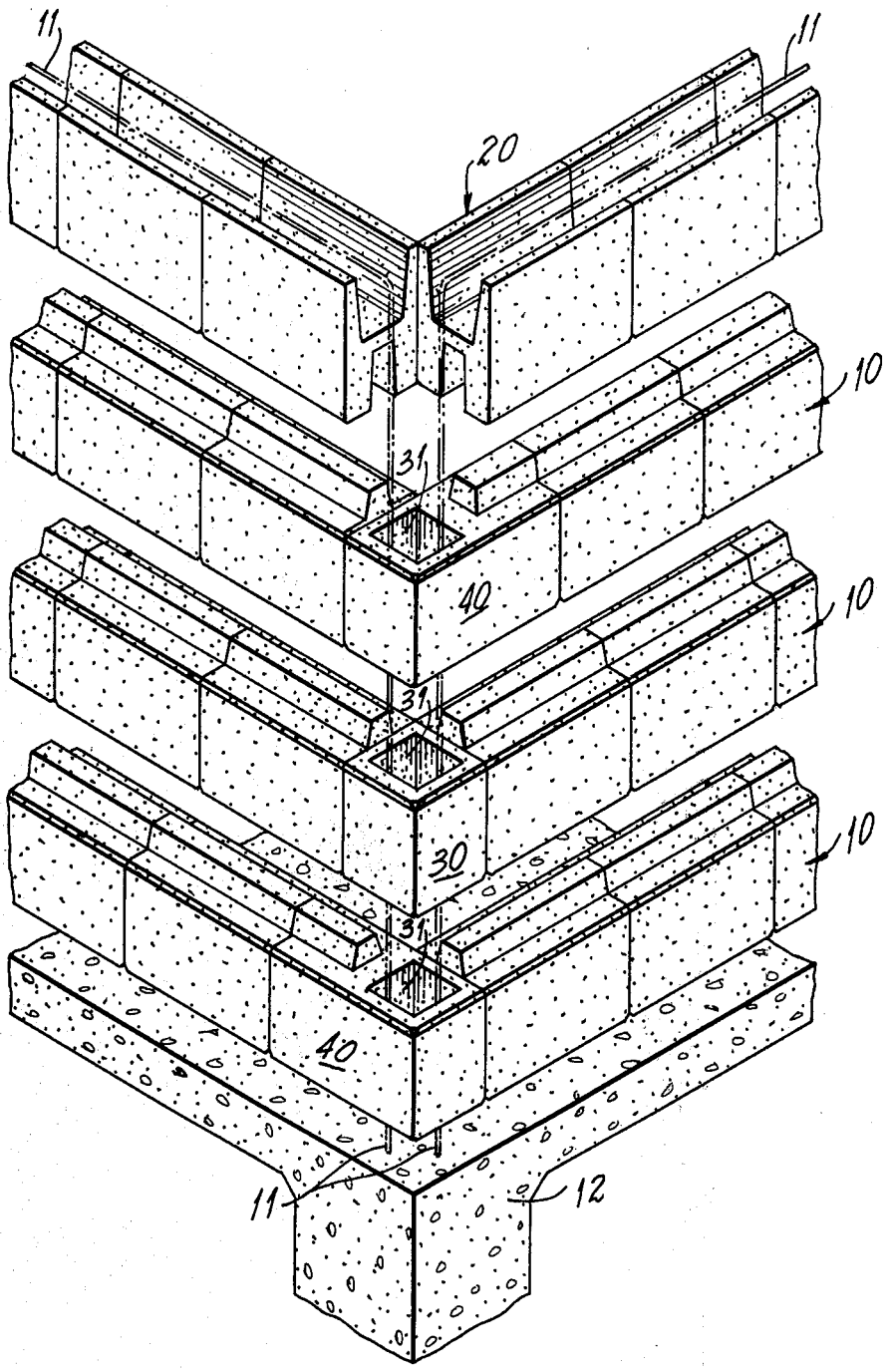
FIG. 6 shows a wall structure utilizing the blocks shown in FIGS. 1 through 4.
Figure 14:
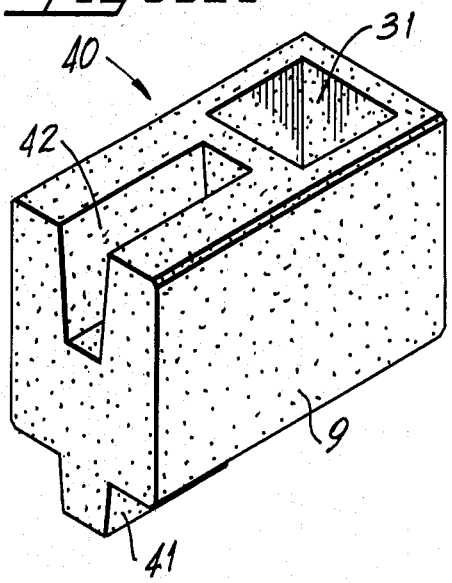
FIG. 14 is a bottom view, in perspective, of FIG. 4.

FIG. 3 shows cube mortarless block 30, which is substantially a hollow rectangular prisma having the size of one half of the size of the standard block and having a vertical column opening 31. Block 30 is intended to be used in conjunction with column mortarless block 40, shown in FIGS. 4 and 14. In FIG. 6, a typical use of these two blocks 30 and 40 is illustrated. It can be observed that the use of blocks 30 and 40 is alternated between abutting rows, from the foundation up. FIG. 4 shows the column mortarless block 40 which has the same overall dimensions as standard block 10 and a partial longitudinal trapezoidal built-in protrusion 41 on one half of the top surface of block 40 with its respective partial longitudinal trapezoidal slot 42 carved in this same half of the block. The other half of block 40 defines a vertical column opening 31 through which mortar may be poured reinforced with iron rods 11 that extend all the way down to the foundation 12. FIG. 14 is another view of FIG. 4 showing the bottom of column block 40 so that the relative position of partial slot 42 and vertical column opening 31 may be appreciated.

Figure 15:
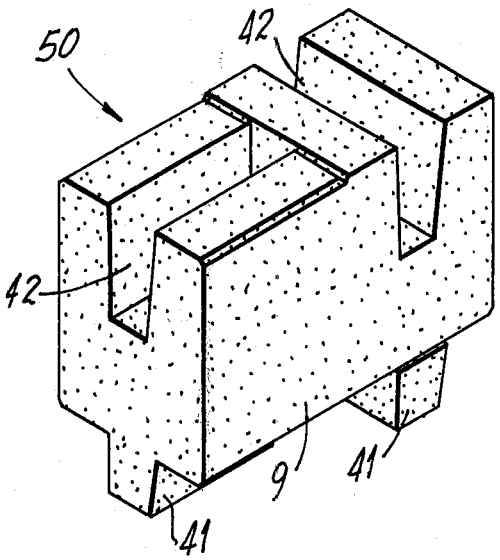
FIG. 15 is a bottom view, in perspective, of FIG. 5.

FIG. 5 illustrates a corner mortarless interlocking block 50, again, having the same overall dimensions as standard block 10. The corner block 50 has two partial longitudinal trapezoidal built-in protrusions 41 of approximately the same size, perpendicular to each, with their respective partial longitudinal trapezoidal slots 42 beneath said partial protrusions 41. FIG. 15 shows the bottom of corner block 50 so that the relative position of the above mentioned partial slots 42 and partial protrusions 41 may be appreciated.

Figure 7:
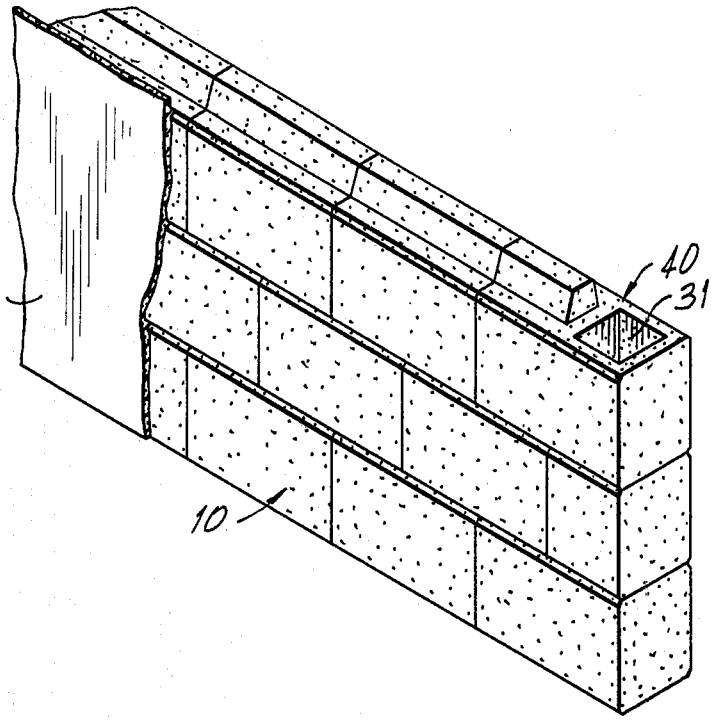
FIG. 7 is a view, in perspective, of a wall structure using cooperating staggered blocks.
Figure 8:
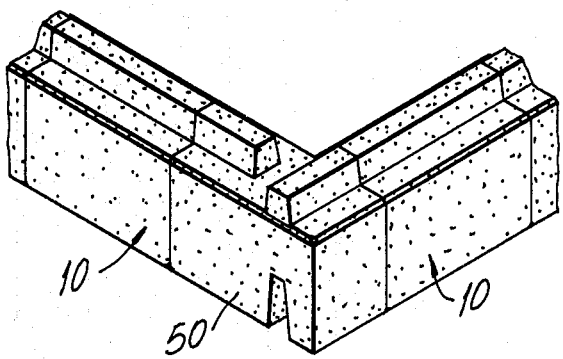
FIG. 8 shows a wall structure illustrating the use of the corner block shown in FIG. 5.

The invention relates then to a system of mortarless interlocking building blocks that facilitate and simplify the erection of wall structures. The blocks described above may be used for all possible requirements associated in the construction of wall structures for dwellings and buildings. FIG. 7 shows a typical wall structure using the standard block 10 and corner block 40, with an optional plaster finish 13. FIG. 8 illustrates the typical use of corner block 50 with standard block 10 showing the continuity and alignment of protrusion 2 in standard blocks 10 with the partial protrusions 41 of corner block 50.

Figure 9:
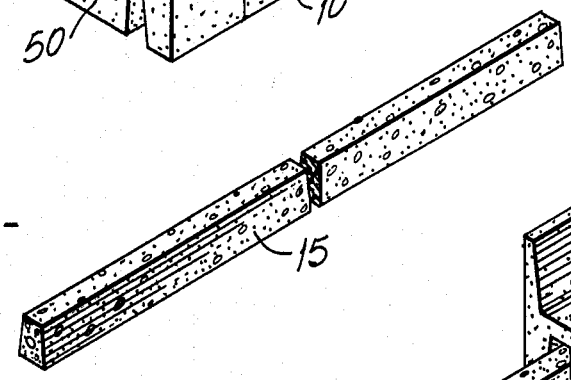
FIG. 9 shows a lintel rib member.
Figure 10:
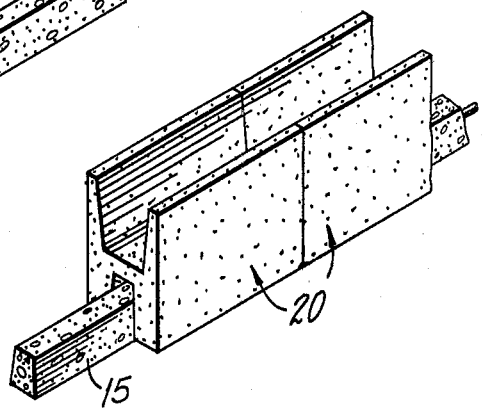
FIG. 10 illustrates the use of the lintel rib in conjunction with cooperating tie beams.
Figure 11:
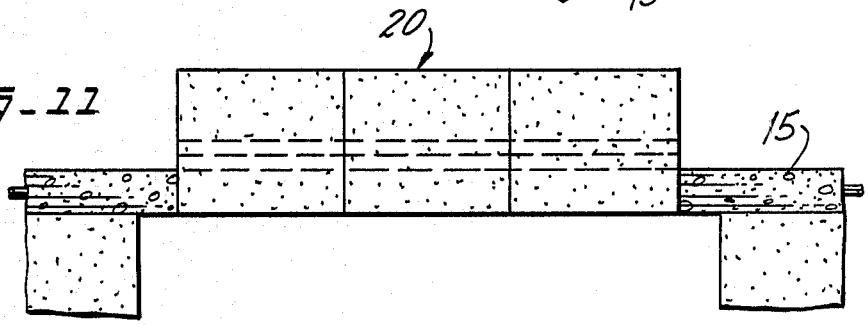
FIG. 11 illustrates the use of the lintel rib as the supporting horizontal member in an opening of a wall structure built with the blocks of the present system.

In FIG. 9, a rib 15 is shown having an elongated shape and a trapezoidal cross-section. Rib 15 snuggly fits in slot 3 of standard block 10 and tie beam block 20. A typical application is shown in FIG. 11.

FIG. 12 shows two abutting standard blocks 10, one on top of the other, having a plurality of conduits 14 (electrical wires, plumbing pipelines, etc) placed through the connecting longitudinal openings of standard blocks 10. It is possible to fill these connecting longitudinal openings with thermic or accoustic insulators also. FIG. 12 also shows a connecting longitudinal space 4 that may also be filled with an insulator or, if desired, a binder 16 may be used to further strengthen the wall structure.

What I claim is:

1. In a mortarless building wall assembly of interlocking wall block members, the combination comprising, a first plurality of standard building blocks, each of which has body portion in the shape of an elongated rectangular prism, each standard building block being integrally formed with a protrusion extending longitudinally and centrally along one side thereof and being formed with slot extending longitudinally and centrally within and along the opposite side thereof, said protrusion and said slot being of complemental interfitting cross-sectional shape to provide for face-to face interlocking disposition of a first course of said standard blocks with respect to a second course thereof in a wall structure, a second plurality of tie beam blocks, each tie beam block of which has a body portion in the shape of an elongated rectangular prism, each tie beam block being formed with a first concrete forming slot extending longitudinally and centrally along one side thereof and a second slot extending longitudinally and centrally within and along the opposite side thereof, said second slot and said protrusion of said standard building block being of complemental interfitting cross-sectional shape to provide for face-to-face interlocking disposition of a course of said tie beam blocks with respect to the top course of said standard blocks in a wall structure, and a third plurality of column blocks, each of which column blocks has a body portion in the shape of an elongated rectangular prism, each column block being formed with a protrusion extending longitudinally and centrally along one side thereof to a distance of about one-half of said column block length, and being formed with a slot extending longitudinally and centrally within and along the opposite side thereof and substantially coextensive with respect to said column block protrusion, said column block protrusion and slot being of complemental interfitting cross-sectional shape to provide for face-to-face interlocking disposition of a vertical column of said column blocks interspaced with end portions of alternate courses of said standard building blocks and the other one-half of said column block including a through opening extending between said one side and said opposite side thereof and further including a plurality of cube blocks fitted between outwardly projecting end portions of a plurality of vertical column block interspaced with end portions of alternate courses of said standard building blocks, said cube blocks being formed with side-to-side through openings in registry with said through openings of said column blocks when so interspaced therewith to provide a continuous, internal, vertical void for the reception of concrete for strengthening purposes.

* * * * *